US011976816B2

(12) United States Patent
Sullivan et al.

(10) Patent No.: US 11,976,816 B2
(45) Date of Patent: May 7, 2024

(54) METHOD AND APPARATUS FOR IMPROVED OPERATION OF CHEMICAL RECOVERY BOILERS

(71) Applicant: Sullivan, Higgins, and Brion Power Plant Engineering, LLC, Mobile, AL (US)

(72) Inventors: Eugene Sullivan, Mobile, AL (US); Daniel R Higgins, Tigard, OR (US)

(73) Assignee: Sullivan, Higgins, and Brion PPE, LLC, AL (US)

( * ) Notice: Subject to any disclaimer, the term of this patent is extended or adjusted under 35 U.S.C. 154(b) by 0 days.

(21) Appl. No.: 17/597,284

(22) PCT Filed: Mar. 4, 2021

(86) PCT No.: PCT/US2021/020904

§ 371 (c)(1),
(2) Date: Dec. 30, 2021

(87) PCT Pub. No.: WO2021/178687

PCT Pub. Date: Sep. 10, 2021

(65) Prior Publication Data

US 2023/0175689 A1 Jun. 8, 2023

Related U.S. Application Data

(60) Provisional application No. 62/984,887, filed on Mar. 4, 2020.

(51) Int. Cl.

| | |
|---|---|
| ***F23G 5/00*** | (2006.01) |
| ***D21C 11/10*** | (2006.01) |
| ***D21C 11/12*** | (2006.01) |
| ***F23G 5/50*** | (2006.01) |
| ***F23G 7/04*** | (2006.01) |

(52) U.S. Cl.

CPC ..... *F23G 5/006* (2013.01); *D21C 11/10* (2013.01); *D21C 11/122* (2013.01); *F23G 5/50* (2013.01); *F23G 7/04* (2013.01)

(58) Field of Classification Search
None
See application file for complete search history.

(56) References Cited

U.S. PATENT DOCUMENTS

| | | | |
|---|---|---|---|
| 4,822,428 | A | 4/1989 | Goodspeed |
| 5,121,700 | A | 6/1992 | Blackwell et al. |

(Continued)

FOREIGN PATENT DOCUMENTS

| | | | |
|---|---|---|---|
| EP | 1408153 | B1 | 8/2007 |
| FI | 103905 | B1 | 10/1999 |

OTHER PUBLICATIONS

MacCallum. Maximize then optimize the reduction efficiency in a kraft recovery boiler. 1-29,_. Western Canada BLRBAC meeting in Vancouver in Apr. 2014. [Retrieved on Dec. 30, 2021].Retrieved from the internet <URL:http://www.wcblrbac.org/files/5814/0553/8831/2014_MacCallum_MaximizeThenOptimizeRedEffy_WesternBLRBAC_Text.pdf entire document.

(Continued)

*Primary Examiner* — Jason Lau
(74) *Attorney, Agent, or Firm* — Michael Scheinberg; Scheinberg & Associates, PC

(57) ABSTRACT

A chemical recovery boilers is described in which the primary air system is reconfigured to provide aggressive charbed control and improved combustion in the lower furnace. The fewest number of primary air ports are used on two opposing walls to generate powerful air jets that penetrate across the boiler providing physical and thermal stability to the charbed while increasing the heat release and combustion stability in the lower furnace, increasing reduction efficiency, and lowering carryover and emissions. Various embodiments are described including operating strategies and multi-level black liquor injection.

9 Claims, 4 Drawing Sheets

(56) References Cited

U.S. PATENT DOCUMENTS

| | | | | |
|---|---|---|---|---|
| 5,305,698 | A | 4/1994 | Blackwell et al. | |
| 5,307,745 | A | 5/1994 | Higgins et al. | |
| 6,302,039 | B1 | 10/2001 | MacCallum et al. | |
| 6,742,463 | B2 | 6/2004 | Saviharju et al. | |
| 6,932,000 | B2 | 8/2005 | Ruohola et al. | |
| 7,069,866 | B2 | 7/2006 | Uppstu | |
| 7,185,594 | B2 | 3/2007 | Higgins et al. | |
| 7,207,280 | B2 | 4/2007 | Saviharju et al. | |
| 7,694,637 | B2 | 4/2010 | MacCallum et al. | |
| 2002/0043192 | A1* | 4/2002 | Philippe | F23L 7/00 110/348 |
| 2004/0149185 | A1 | 8/2004 | Saviharju et al. | |
| 2004/0221779 | A1 | 11/2004 | Ruohola et al. | |
| 2005/0039647 | A1* | 2/2005 | Katsui | F23G 5/245 110/165 R |
| 2005/0061217 | A1* | 3/2005 | Uppstu | F23G 7/04 110/238 |
| 2017/0191661 | A1 | 7/2017 | Imig | |

OTHER PUBLICATIONS

Vakkilainen, E.K., Kraft recovery boilers—Principles and practice (2005).

Apr. 17, 2023 Office action for corresponding Finnish App. No. 20225875.

Apr. 17, 2023 Search Report for corresponding Finnish App. No. 20225875.

* cited by examiner

VIEW A-A

VIEW B-B

VIEW B-B

METHOD AND APPARATUS FOR IMPROVED OPERATION OF CHEMICAL RECOVERY BOILERS

TECHNICAL FIELD OF THE INVENTION

This description relates to chemical recovery boilers.

BACKGROUND OF THE INVENTION

Chemical recovery boilers are well known in the pulp and paper industry as a means to recover spent cooking chemicals and the heating value of the black liquor fuel fired therein. In the Kraft pulping process, wood chips are processed (or cooked) in a digester in which they are subjected to high temperature and pressure in the presence of caustic chemicals. In the digester the lignin binding the wood fibers is dissolved liberating the fibers to be used to make pulp. The Kraft process produces relatively long fibers that are used to manufacture strong paper products and is commonly used in all sorts of packaging. After the wood chips are dissolved the spent cooking chemicals, dissolved lignin, and unsuitable wood fibers are captured, the excess moisture is evaporated, and the resulting black liquor is fired in a recovery boiler. After evaporation, the moisture content of the black liquor typically ranges from 20% to 40% depending on the equipment and operation of the individual mill. The black liquor solids consist of approximately 50% inorganics (spent cooking chemicals) and 50% organic material (lignin and wood fibers). The black liquor is injected into the recovery boiler through one or more atomizing spray nozzles, the residual moisture is evaporated, and the organic material is burned. During the combustion process the spent cooking chemicals are liberated and undergo chemical reduction. The predominant spent cooking chemical in a black liquor recovery boiler is sodium sulfate (Na2SO4) and in the presence of heat and elemental carbon is reduced to sodium sulfide (Na2S). This is an endothermic reaction absorbing heat from the combusting volatiles and char. Reduction efficiency is the ratio of the concentration of the total sulfur in the smelt minus the concentration of sulfate divided by the total sulfur (on a practical basis this can be expressed as Na2S/(Na2S+Na2SO4)). Reduction efficiencies of 95% or higher can be achieved on well-run recovery boilers. Other types of recovery boilers are used such as soda boilers and red liquor boilers in which different chemical mixtures are used to dissolve the wood chips, but black liquor boilers are the most common type by far. We will limit our discussion to black liquor boilers, but the methods and apparatuses described herein pertain to the other types of chemical recovery boilers that use similar combustion system arrangements as black liquor boilers.

Recovery boilers are typically constructed with a square or rectangular plan-form in the furnace (combustion) section, typically from 10 feet to 30 feet or more on a side. The floor and walls of the furnace are constructed from steel boiler tubes in a parallel array seal welded to the adjacent tubes. The floor may be flat or sloping about 5 degrees and the walls are vertical forming a large prismatic enclosure from 30 to 100 feet tall. At the top of the furnace one of the walls (typically the rear wall) of the boiler is bent inward forming a bullnose section that turns the hot combustion gases across the convective heat transfer tubes arrayed at the top of the boiler. The convective sections typically consist of one or more superheaters, a steam generator (generating bank or boiler bank), and one or more economizers. The tubes forming the furnace floor are fed by a header at one edge of the floor and turn vertically to form one of the furnace walls opposite the header. In some boilers one or two centrally located headers feed the floor tubes that then feed into two opposite walls. The other walls are fed by their own headers and the headers are fed boiler feed water via one or more downcomers from a water drum at the bottom of the generating bank in a two-drum boiler, or the steam drum in a single drum boiler. A natural circulation system cools the furnace wall tubes in which the hydraulic head from the cooler and denser boiler feedwater in the downcomers pushes the hotter and less dense water in the furnace wall upwards. Radiation is the dominant heat transfer mechanism in the furnace section of the boiler and most of the saturated steam is generated in the furnace walls.

The black liquor fuel is injected into the furnace at one or more locations on one or more of the furnace walls. Larger recovery boilers may typically use three or more injection nozzles per wall and 10 or more injection nozzles total. All nozzles are typically at a single elevation, generally considered the operating level as the liquor injection requires regular attention by the operators. The nozzle elevation may range typically from 15 to 30 feet above the floor. When the liquor is injected into the boiler it goes through several combustion stages including drying, devolatilization, char burning, and smelt formation. After the liquor drops are dried, pyrolysis gases are produced (CH4, CO, H2) and the liquor droplets puff up like popcorn such that their volume and surface area increases as their mass decreases. This increases the buoyancy of the liquor particles during the char burning phase in which the remaining carbon is consumed. After combustion is complete the remaining inorganic chemicals form a droplet of smelt (the molten form of the chemicals, predominantly sodium sulfate). During the combustion phase, some of the liquor falls to the bottom of the boiler where it forms a charbed, so called because it consists of liquor drops in the char burning phase. The charbed typically forms a mound in the middle of the boiler although the size and shape of the charbed may vary considerably from boiler to boiler and from time to time within a given boiler. Some of the liquor lands on the walls and may stick there while the combustion process is completed, and some of the drops are entrained in the gas flow within the furnace and may be carried to the convective sections at the top of the boiler where they adhere to the superheater and generating bank tubes and can completely block the flow of gas if they are not removed. Steam sootblowers are commonly used to periodically blow the adherent material from the tubes, but sootblowing is not 100% effective and can consume a lot of steam and that reduces the overall efficiency of the boiler. By the time the liquor drops reach the convective sections they are mostly smelt with some residual carbon and this material is called carryover. In addition to the carryover, sodium vapor is generated, combines with free sulfur and oxygen in the flue gas, and condenses as sodium sulfate on the superheater, generating bank, and economizer tubes. This material is commonly called saltcake and is recovered by sootblowing where it falls into hoppers and is mixed with the incoming black liquor. The sodium fume is beneficial in that it captures the sulfur in the flue gases that would otherwise be emitted or require additional treatment of the flue gas.

The combustion air system of a black liquor recovery boiler consists of the fans, air heaters, ducting, nozzles, control dampers, port cleaners, port dampers, port openings, instrumentation, etc. that provides and controls the flow of combustion air to the boiler. Since the first Tomlinson black liquor recovery boiler of 1929, combustion air has been blown into the boiler by a series of closely spaced openings around the bottom of the boiler with the openings about three feet or so above the floor of the boiler. Ten to forty or more ports are typically arrayed on each side, depending on the size of the boiler. This was done to maintain the perimeter of the char bed at a lower level than the middle of the bed to promote smelt drainage at the perimeter of the floor. As the charbed builds up in the middle of the boiler the added weight compacts the bed and makes it harder for the smelt to drain, and the weight of the bed displaces the smelt to the walls. The very early recovery boilers had one level of air ports, but additional levels were added over the years and today recovery boilers commonly have three to six levels of air injection with multiple ports at each level in a variety of arrangements to promote good combustion in the boiler. The lowest level of ports is called the primary level and consists of a series of closely spaced combustion air ports around all four walls of the boiler, more or less equally spaced vertically about three feet or so above the floor. The next level up is traditionally called the secondary level but on some older boilers it was called the high primary Starting burner ports are often included at that level. Modern recovery boiler air systems may have two or more levels of secondary air ports with the defining characteristic being the secondary ports are above the primary ports and below the liquor spray ports. One to three or more levels of tertiary combustion air ports are commonly used above the liquor spray with the uppermost level sometimes called the quaternary level. Load burner ports are also sometimes present above the liquor spray level where gas or oil-fired burners are located to increase the steaming rate when needed. Many arrangements of combustion air ports have been used over the years and many patents have been issued in recent years for improved combustion systems for recovery boilers, including U.S. Pat. Nos. 6,742,463; 6,932,000; 7,069,866; 7,185,594; 7,207,280; and 7,694,637. One feature these systems all have in common are closely spaced (6-15" apart) primary air ports on at least two opposing walls of the boiler.

Traditionally the role of the primary air ports was to control the perimeter of the charbed at a relatively low level to promote drainage of smelt around the perimeter of the boiler. The secondary air system is meant to control the top of the char bed and promote good combustion and is generally designed with fewer and larger combustion air ports arrange for good penetration and mixing. Secondary combustion air ports are typically located on two or all four walls. The tertiary and quaternary air ports are generally located on two opposing walls of the boiler and help to complete the combustion and minimize undesirable emissions.

At the bottom of the furnace openings are made in one or two of the walls at the floor elevation to drain the smelt from the boiler through smelt spouts. Much of the smelt is generated in the charbed, some is generated on the walls, and some is generated in suspension and either falls to the charbed or is carried out the top of the furnace as carryover. The recovered smelt flows into a dissolving tank where it is diluted into green liquor and returned to the pulp mill to be reconstituted into the caustic chemical required for the digestors. To reach the smelt spouts, the smelt must percolate through the charbed and traditionally flows mostly around the perimeter of the floor below the primary ports because that is where the charbed is shallowest. The smelt is very hot and generates heat flux to the floor where it is flowing and as was stated, that is mostly around the perimeter. It was also mentioned that radiation is thought to be the dominant heat transfer phenomenon in the furnace. Radiant heat transfer is influenced by the so-called shape factors of the enclosure. For recovery boilers, with their rectangular plan-form, this means that the corners of the boiler receive significantly less radiant heat than the middle of the walls. It has also been described that the tubes comprising the floor and walls form part of a natural circulation system driven by the radiant heat flux to the walls. Considering there is less heat flux in the corners there is also less circulating water through the floor tubes running adjacent to the walls of the boiler, therefore, those floor tubes are more susceptible to overheating because they have more heat flux from the smelt flow but less cooling water flow.

Another problem with traditional primary air systems is that they do not promote good combustion and overall charbed stability. It is very common for the charbed to be flat around the perimeter at or below the bottom of the primary air ports, then about two to three feet in from the wall the bed slopes up to one or more mounds. The mound can be localized like a termite mound or more spread out like a series of small hills. The shape of the charbed is determined by the interactions between the primary and secondary air flows and the liquor sprays. In any case a stable char bed is very desirable to promote consistent operation of the boiler with high throughput and low emissions. A common problem with charbeds is a steep sided mound will grow until it becomes unstable and collapses. The fuel contained in the mound is shielded but when it collapses it suddenly releases that additional fuel, but the combustion air system has no means to respond (it runs at a more or less steady state) therefore the volatiles are not completely consumed and emission spikes can ensue. Another potential problem with an unstable char bed is when a mound collapses and blocks the primary ports causing a black out condition. This blocks the air flow causing combustion problems and must be cleared and creates a lot of work for the operators. The dominant role of the primary air is to control the perimeter of the charbed and that often means supplying more air than is required for good combustion. The fuel-to-air ratio around the perimeter of the boiler at the primary level is usually very lean and after entering the boiler the air is deflected upward by the charbed where it interferes with the secondary air jets and increases the bulk upward velocity of the gases in the furnace and that in turns increases the undesirable carryover and pushes the combustion higher in the furnace. Lowering the combustion in the boiler is desirable to improve the heat release to the walls to increase the water circulation, promotes a more stable charbed, increases sodium fume production, and improves the reduction efficiency.

A lot of work has gone into improving the combustion in recovery boilers over the last twenty five years, but a complete rethinking and modernization of the primary air system has been anathema. In the current state of the art, it is sacred that recovery boilers have many closely spaced primary ports. The methods and apparatuses described below finally addresses the inherent deficiencies of the status quo.

SUMMARY OF THE INVENTION

An object of the invention is to provide a method and apparatus for an improved recovery boiler.

A chemical recovery boiler includes no primary combustion air ports on the wall opposite the spout wall. In some embodiments, the boiler includes at least two but no more than seven primary ports on each of the two walls adjacent to the spout wall.

The foregoing has outlined rather broadly the features and technical advantages of the present invention in order that the detailed description of the invention that follows may be better understood. Additional features and advantages of the invention will be described hereinafter. It should be appreciated by those skilled in the art that the conception and specific embodiments disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a more thorough understanding of the present invention, and advantages thereof, reference is now made to the following descriptions taken in conjunction with the accompanying drawings, in which.

DETAILED DESCRIPTION OF A PREFERRED EMBODIMENT

The principals described herein can be used in the construction of new chemical recovery boilers and/or retrofitting existing chemical recovery boilers. The description below is directed to chemical recovery boilers and inherently to a method of making and operating an improved chemical recovery boiler.

Figure 1:
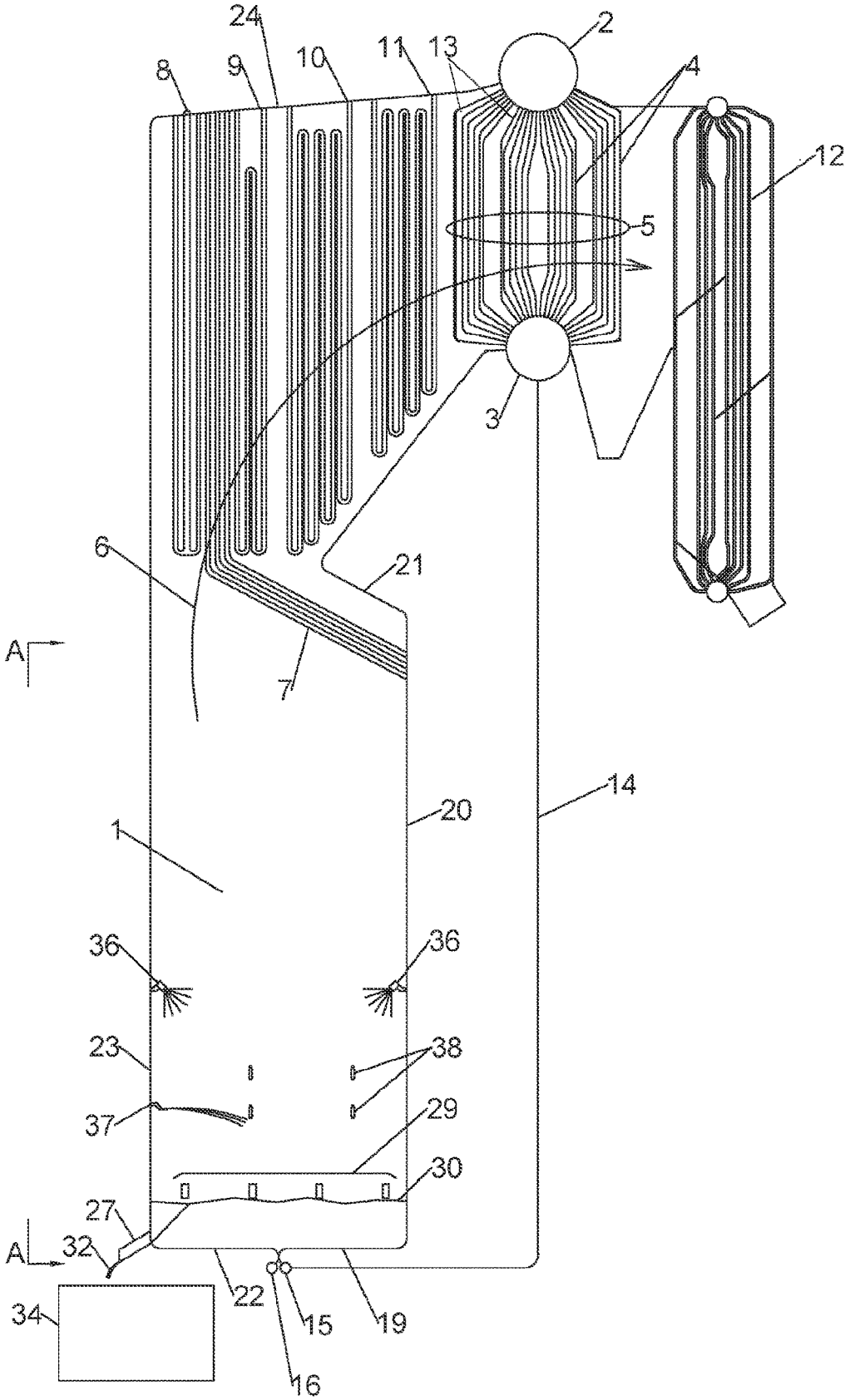
FIG. 1 is a side view of recovery boiler in which tubes and pipes are depicted as single lines.
Figure 2:
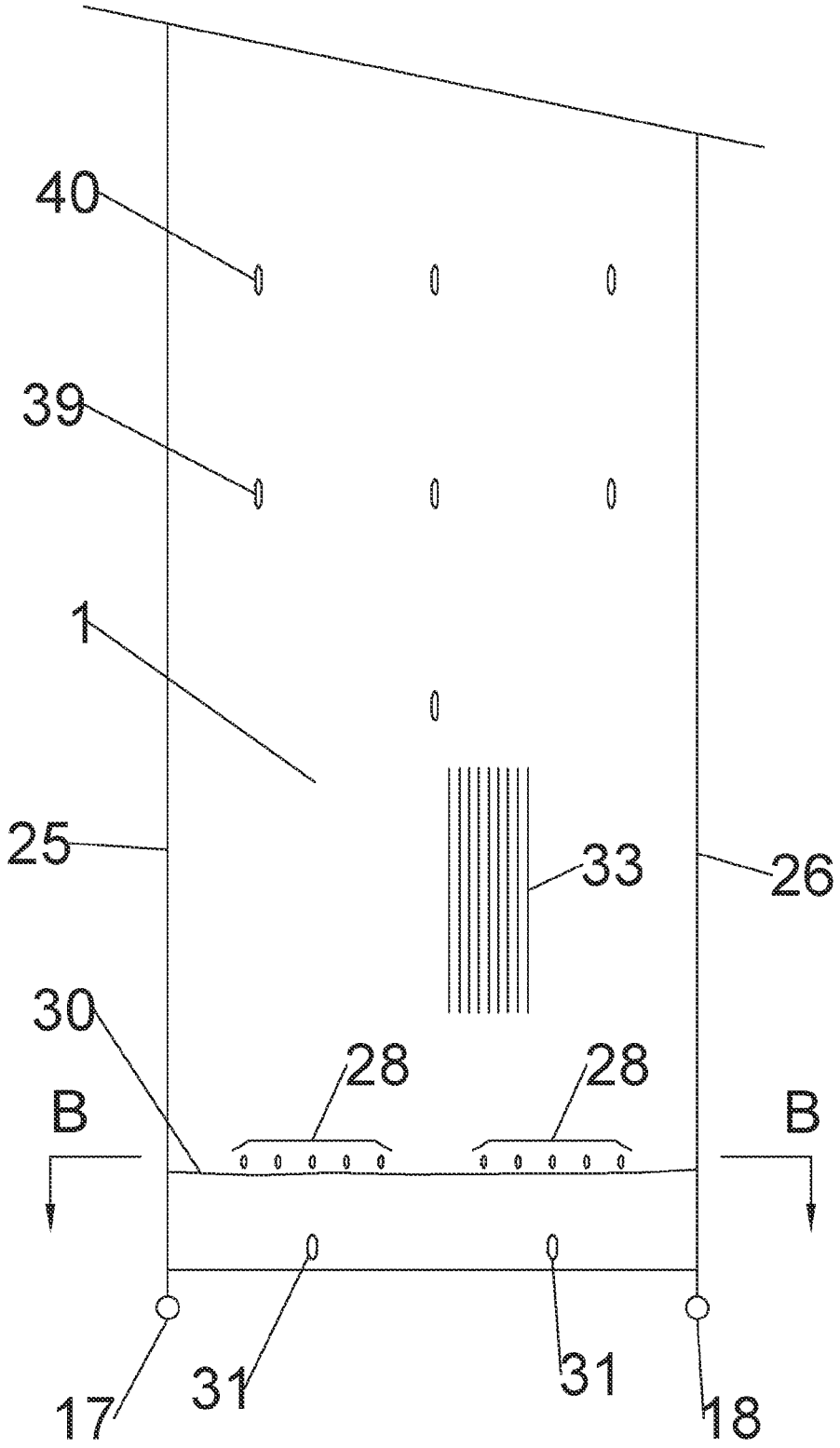
FIG. 2 is a partial front view of the boiler of FIG. 1 as viewed along lines A-A.
Figure 3:
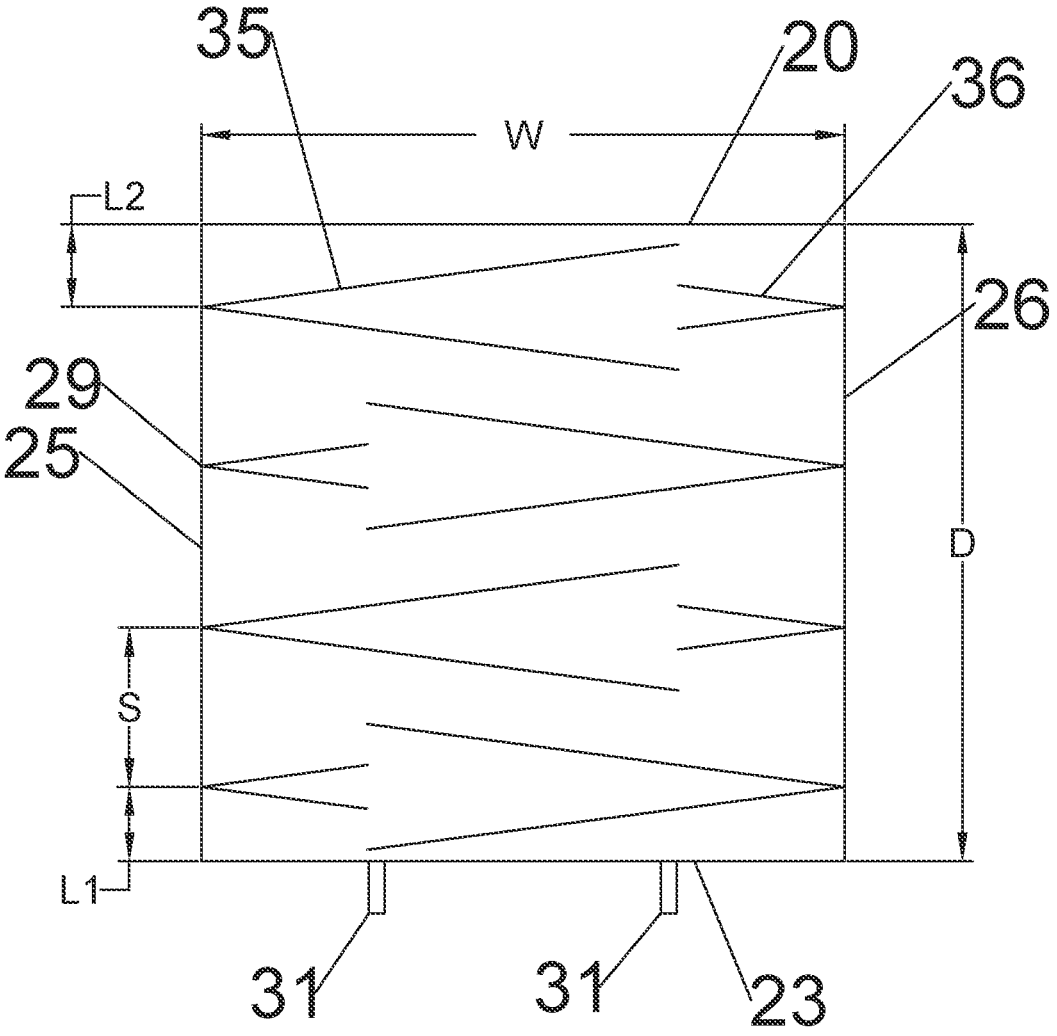
FIG. 3 is a sectional view of the boiler in FIG. 1 at the primary port level, the section taken along the section lines B-B and showing a first primary port arrangement.

The following description references features in the accompanying figures in which the features are identified by like numbers. FIG. 1 is a side view of recovery boiler in which tubes and pipes are depicted as single lines. FIG. 2 is a partial front view of the same boiler as identified by section lines A-A. FIG. 3 is a plan view of the boiler in FIG. 1 at the primary port level as identified by section lines B-B showing a first primary port arrangement, and FIG. 4 also shows section view B-B but depicts a second primary port arrangement.

Referring to FIGS. 1 and 2, recovery boiler 1 is an older two-drum type using steam drum 2 and water drum 3. The walls and floor of the boiler are constructed of closely spaced tubes 33 (a few of which are shown) in a vertical parallel array, seal welded together to make an air-tight enclosure. The tube walls are constructed with a uniform pitch between the tubes. Boiler feedwater is fed to steam drum 2, some of which flows down the rear tubes 4 of generating bank 5 to the water drum 3 picking up heat from the flue gases 6 that cross screen 7, superheaters 8-11, generating bank 5, and economizer 12. Flue gases 6 are hotter at the inlet to generating bank 5 therefore the water in front tubes 13 absorbs more heat than the water in rear tubes 4 and a natural circulation is created between steam drum 2 and water drum 3.

Some of the water in water drum 3 flows down downcomer 14 to headers 15-18. The water in header 15 flows through floor 19 then up rear wall 20, through the bullnose 21, and back to water drum 3. Similarly, the water in header 16 flows through floor 22, up front wall 23, through the roof tubes 24, and back to steam drum 2. Sidewall headers 17 and 18 feed sidewalls 25 and 26 respectively and are relieved by headers at the top (not shown) back to steam drum 2. Radiant heat from the combusting fuel is absorbed by walls 20, 23, 25, and 26 producing steam and setting up a natural circulation system.

Forced-draft combustion air is fed through primary ports 28, primary air ports 29, secondary ports 38, tertiary ports 39, and quaternary ports 40 if present. Most chemical recovery boilers in operation today have smelt spouts on one wall of the boiler, but some older Combustion Engineering units drain the smelt from two opposing walls. The apparatus described herein is particularly suitable in those boilers that drain smelt from one wall although it can be used on boilers draining smelt from two walls. Smelt spouts 27 are at or slightly above the level of the floor of the boiler whereas the spout wall primary ports 28 and the primary air ports 29 are several feet higher. Around the perimeter of the boiler charbed 30 is below the primary ports but it is still above the height of spout openings 31. At spouts 27 the flowing smelt 32 tends to keep the charbed lower, but it can still be problematic to keep the molten smelt running freely in the spouts. The molten smelt falls into dissolving tank 34 where it is turned into green liquor to be reused.

It is necessary therefore to have some primary ports 28 in operation in close proximity to the smelt spouts, preferably one to ten ports, more preferably two to eight ports, and most preferably three to five ports centered on each spout. These ports are sized and located similarly to traditional primary ports on the spout wall (in this case front wall 23) and in fact can be reused ports if the boiler has been modified in accordance with this disclosure. On the spout wall (front wall 23) only those few primary ports at each spout are open. On the wall opposite the spouts (on a single spout-wall boiler, in this case rear wall 20) no traditional primary ports are required. Preferably the area of air ports on the wall opposite the spout wall is zero, or less than 50%, less than 25%, less than 10%, less than 5%, or less than 1% of the area of ports on the spout wall. If the boiler has been modified in accordance with this disclosure, the existing ports may be blocked with refractory or some other means, or the port tubes, originally bent to create the openings, can be replaced with straight tubes. On the two walls adjacent (perpendicular) to the spout wall (in this case sidewalls 25 and 26), no traditional primary ports exist. Combustion air ports 29, much larger than traditional primary ports, are present instead. As on the other walls, if the boiler is modified to incorporate this disclosure, the existing primary ports are blocked, replaced with straight tubes, or replaced with new bent tubes creating the new larger port openings. In some embodiment, the primary air ports on the two walls adjacent (perpendicular) to the spout wall provide more than 80% of the primary air port area, with the air ports on the spout wall and the wall opposing the spout wall providing less than 20% of the primary air port area. In some embodiment, the primary air ports on the two walls adjacent (perpendicular) to the spout wall provide more than 90% of the primary air port area, with the air ports on the spout wall and the wall opposing the spout wall providing less than 10% of the primary air port area. In some embodiment, the primary air ports on the two walls adjacent (perpendicular) to the spout wall provide more than 95% of the primary air port area, with the air ports on the spout wall and the wall opposing the spout wall providing less than 5% of the primary air port area.

Conventional primary port openings on recovery boilers typically range from one inch wide by six inches tall to two inches wide by eleven inches tall. The upper limit is 2½ inches by 15 inches. The new ports, as part of the present disclosure, will be many fewer and much larger than the original primary ports. For example, if the primary ports on a recovery boiler are 1.5 inches wide by eight inches tall, and there are 80 such ports on the boiler, the total primary port area is 1.5×8×80=960 square inches. With the implementation of the present invention, 90% of the primary ports may be replaced totaling 864 square inches. If eight new ports are installed in their place, each port will have an area of 108 square inches. In that case the new ports may be 6 inches wide by 18 inches tall. The actual dimensions may vary from this example depending on the practical requirements of each system.

The total area of the primary air ports in a recovery boiler being retrofitted in accordance with this disclosure may be approximately the same as the area of the air ports in the recovery boiler prior to being retrofitted. For example, the total area of the primary air ports in a recovery boiler in accordance with this disclosure may be within plus or minus 40%, plus or minus 30%, plus or minus 20%, plus or minus 10%, or plus or minus 5% of the area of the air ports in the recovery boiler prior to being retrofitted.

Referring to FIG. 3, the number of primary ports 29 on these two walls is dictated by the size of the boiler and the optimum spacing between the ports. The optimum spacing may be a low as three feet for small boilers and up to seven feet for large boilers. Air jets expand as they flow across a boiler therefore for larger boilers, the air jets travel farther and expand more and must start out farther apart to avoid interference with adjacent or opposing air jets. The minimum horizontal spacing between primary air ports is given by Formula 1: S=0.13*W, adjusted to match the tube pitch or other features of the boiler, where S is the nominal horizontal spacing between ports, and W is the plan-form dimension of the boiler parallel to the direction of the air jets, but shall not be less than 3 feet in any case. Dimension W is from the centerline of one wall to the centerline of the opposite wall. D is the dimension of the boiler perpendicular to W. The maximum number of primary ports on opposing walls 25 and 26 adjacent to spout wall 23 on a square boiler is seven, unless the boiler is over 49 feet on a side, in which case additional ports are added to keep S<7 feet. On rectangular boilers the maximum number of primary air ports on opposing walls 25 and 26 adjacent to spout wall 23 may be greater than seven assuming walls 25 and 26 are longer than walls 20 and 23. It should be noted that a square is a type of rectangle and for our purposes a square boiler is any boiler in which the long sides are less than 3 feet longer than the short sides. These relationships assume the direction of the air jets is orthogonal to the walls on which the air jets originate. All primary air ports are equally spaced +/−0.25*S to allow for variations due to other features on the boiler. Spacing L1 is the distance from spout wall 23 to the first primary air port on adjacent walls 25 and 26, and spacing L2 is the distance from the last primary air port on walls 25 and 26 to wall 20 opposite the spout wall. In general, L1=L2 but this may vary +/−0.25*S or more to accommodate the boiler geometry or other features. L1 and L2 should not be less than 0.75*S as the air jet may be sucked against the adjacent wall by a low pressure zone created by the air jet flowing next to the wall.

Considering that there are fewer primary air ports on the apparatus described herein than in traditional boilers, the primary air ports must be larger. This not only provides the combustion air needed to satisfy the stoichiometric requirements, but also provides more mass flow per air jet and that improves the penetration of the air jets over the charbed. A feature some of the embodiments of the apparatus described herein is that the fewer but larger primary air ports create stronger air jets that penetrate across the boiler providing the combustion air and physical agitation needed to maintain a stable charbed. Typically, about twenty to forty percent of the total combustion air comes from the primary air ports. Knowing the capacity of the boiler, one can determine the stoichiometric requirements for combustion air and determine the required primary air port area using the equations below. A commonly used formula for determining the velocity of an air jet is given as Formula 2: V=67.3*((Pd)*(T/527))^0.5, where V is the velocity of the jet in feet per second, Pd is the differential pressure across the port opening in inches water column, and T is the temperature of the combustion air in degrees Rankine. The formula for determining the area of each port opening is given as Formula 3: Aip=((Q*X)/(V*Cfl*Cfo-Asp))/2N where Aip=area of the individual primary air ports, Q=the total forced draft combustion air to the boiler, X=the fraction of forced draft combustion air to be injected at the primary level, V=the velocity of the air jet, Cfl is a flow coefficient, Cfo is a coefficient of fouling of the port opening (the port openings on a recovery boiler tend to get fouled with char and frozen smelt from the black liquor), Asp is the combined area of the primary ports on the spout wall, and N is the total number of primary air ports. There are other variables that come into play as well. For example, some of the ports may operate at different velocities or flows or be fitted with port dampers that adjust the effective area of the port opening. This will require adjusting the fixed area of the port opening accordingly.

A first embodiment pertains to the primary ports, generally considered to be the lowest forced-draft air ports on each wall. We can additionally define the primary ports as those ports that the bottom of which are no more than five feet above the floor of the boiler, and there are no lower forced-draft air ports on that wall, except those that may be stair-stepped following the slope of the floor. Referring to FIGS. 1 and 2, the primary ports 28 on spout wall 23 will be located at an elevation suitable to protect smelt spouts 27 from char bed 30. On side walls 25 and 26, primary air primary ports 29 will be located at an elevation to provide the desired depth of charbed 30. The primary ports in the apparatus described herein are generally all at the same elevation but this is not necessarily so, the elevation may vary from port to port or wall to wall, within the context of the definition above. Some boilers have sloping floors and in that case the ports may be equidistant above the floor but not at the same elevation. In the first embodiment, primary air primary ports 29 are located on two opposing walls 25 and 26 adjacent to spout wall 23, and every port has a corresponding port opening on the opposite wall and aligned within +/− three tube pitches of the opposite port. The number of port openings on each wall is the same and the minimum spacing is determined by Formula 1. The minimum number of primary air ports is two on each wall 25 and 26 and the maximum is seven, unless the boiler is rectangular. For a rectangular boiler, in which walls 25 and 26 are more than 3 feet longer than walls 20 and 23, the number of ports 29 can be increased by one for each additional length S. Each port opening is fitted with a means to control the air flow through the port, by varying the port area or the port pressure or both. For our purposes, the term air flow includes the volumetric flow, mass flow, and/or velocity of the air jet.

In the apparatus described herein, the air flow through the port automatically fluctuates on a prescribed basis to alter the air flow and combustion characteristics in the boiler and provide aggressive control of the char bed. For example, referring to FIG. 3, the first port on wall 25 may be set to full flow while the port directly opposite on wall 26 is set to partial flow, the second port on wall 25 is set to partial flow while the opposite port on wall 26 is set to full flow, and so on down the wall. This generates strong jets 35 alternating with weak jets 36 over the char bed. Periodically, in a range of one to twenty minutes, the arrangement is automatically reversed so that the strong jets become weak jets and vice versa. The purpose of this arrangement is to provide a strong jet that penetrates across the boiler to control the top of the charbed but is opposed by the weak jet to prevent the char bed from piling against the opposite wall and prevent black liquor, smelt, and char from blowing into the opposite port opening. The air jets have unequal strengths so that the point of contact is not centered on the boiler. Where the air jets contact, they tend to deflect each other upward. Staggering the points of contact prevents the formation of a core of high vertical velocity in the furnace that pushes the fuel, air, and combustion up in the boiler, and that is detrimental as described previously. Formula 2 describes the square root relationship between the differential pressure and resultant jet velocity. If the jet velocity is controlled on a pressure basis, this means that a large difference in differential pressure is required to obtain a modest difference in velocity. For example, to double the velocity of an air jet, the differential pressure must be quadrupled. If a strong jet/weak jet arrangement is used, the lower flow from the weak jets must be taken into account when determining the required area of each port opening.

Figure 4:
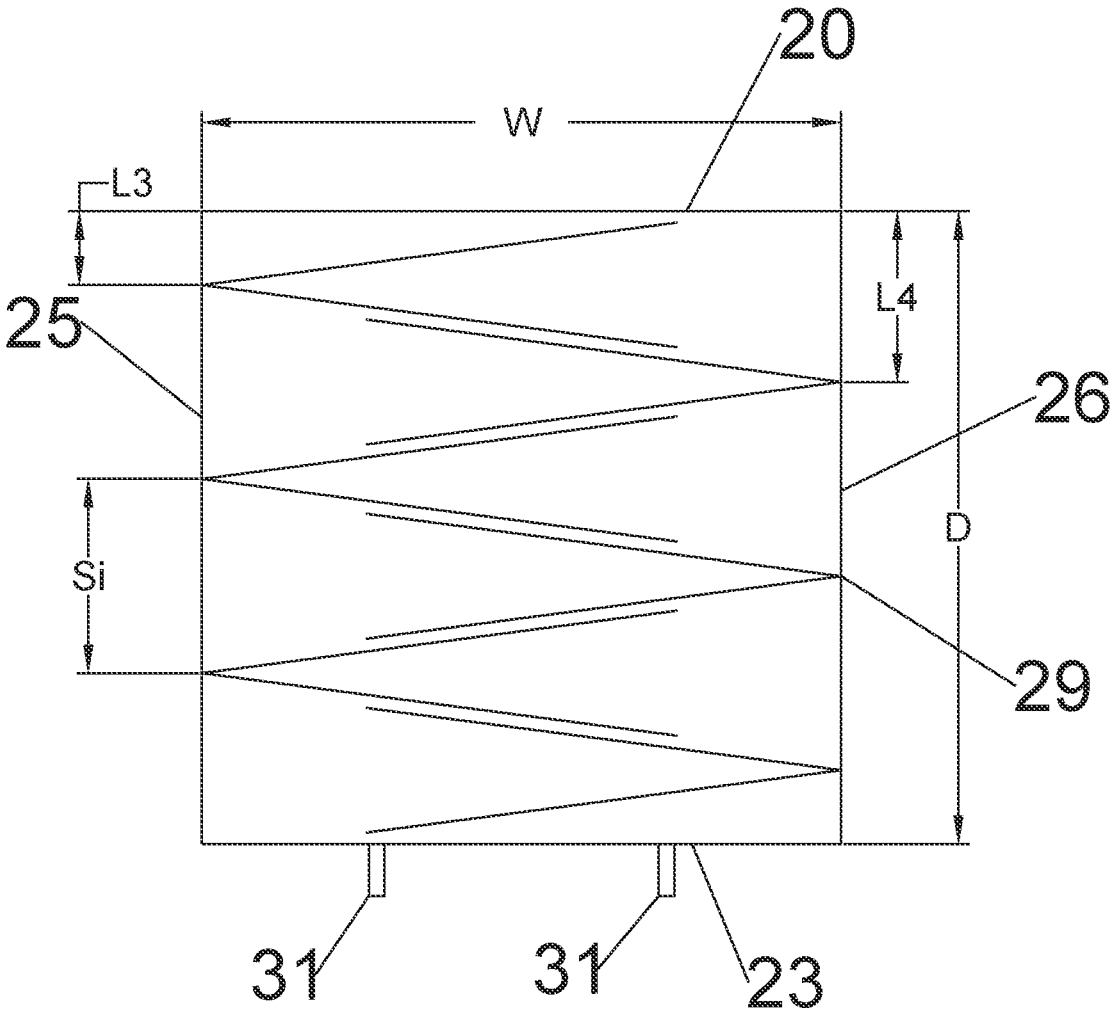
FIG. 4 is a sectional view boiler FIG. 1 taken along the lines B-B at the primary port level showing a different primary port arrangement.

A second embodiment, referring to FIG. 4, has the primary air ports interlaced on opposing walls 25 and 26 adjacent to spout wall 23. In that case the minimum spacing between ports is according to Formula 4: Si=0.26*W and the maximum optimum number of ports 29 on each wall 25 and 26 is three for a square boiler. For a rectangular boiler, in which walls 25 and 26 are more than 3 feet longer than walls 20 and 23, the number of ports 29 can be increased by one for each additional length Si. The nominal distance L3 from the first port on wall 25 to wall 20 should be no less than 0.37*Si, and the nominal distance L4 from the first port on wall 26 to wall 20 should be L3+Si/2. This spaces the air jets out evenly across the boiler with each jet interlaced between two jets on the opposite wall, or between a perpendicular wall and an air jet from the opposite wall. This embodiment has the advantage of being less costly as fewer port openings are required, and the air jets can penetrate completely across the boiler, further reducing the updrafts in the boiler, as the collision between air jets is avoided. With nothing to oppose the air jets, however, the charbed may be piled against the opposite wall to a height that may be problematic. As the air jets travel over the char bed they tend to bend upward (the eventual direction of all of the air) and the ability to aggressively control the charbed is diminished. This embodiment has the advantage of simplicity of design and operation as the periodic reversing of the air jets is not required.

A third embodiment takes advantage of the aggressive charbed control and improved combustion in the lower furnace offered by the primary air ports. In most black liquor recovery boilers, the majority of the forced-draft combustion air is injected below the liquor spray nozzles. This is for practical reasons as the air is needed to burn the fuel, however, the combustion air and gaseous products of combustion must have somewhere to go and in a recovery boiler that direction is up. By creating a strong jet/weak jet arrangement, or interlacing the air jets, strong local updrafts are minimized and the upward pressure on the fuel droplets is reduced. These arrangements have been used for many years at the secondary, tertiary, and quaternary air level but never before at the primary air level as it was assumed that the myriad traditional primary ports were necessary for smelt drainage and char bed control. The primary forced-draft air flow typically represents around 30% of the total air flow, and the secondary around 40%. Using a strong jet/weak jet arrangement or interlacing the secondary air jets has proven effective to improve the combustion in the lower furnace even though the primary air (almost half of the combustion air in the lower furnace) is not participating and in fact interferes with the secondary air jets. By incorporating the primary air into an aggressive mixing and charbed control system using larger and stronger air jets, optimally arranged, the combustion in the lower furnace is enhanced well beyond what can be done at the secondary level alone. This creates an opportunity to push more fuel to the charbed and more fuel that lands on the bed means less fuel burns in suspension and less carryover. Less carryover means the boiler can run longer between cleanings and/or use less steam for sootblowing, or, most importantly for many mills, the boiler can be run at a higher load rate boosting the production of the mill. Referring to FIG. 1, in the current state of the art, one or more black liquor spray nozzles 36 may be located on one or more walls of the boiler, but they are always at the same elevation. For our purposes we will call this the operating level because the operators typically control the boiler from that level. This embodiment incorporates one or more lower black liquor spray nozzles 37 at an elevation lower than the operating level but at least two feet above the primary port elevation and no more than twelve feet above the bottom of the boiler, and preferably below the injection of the secondary air. By spraying liquor at a lower elevation, the fuel is subjected to less updraft and therefore carryover is reduced, and the fuel is burned in the lower furnace where it belongs. This can only be done with a very strong primary air system.

Multiple versions of these embodiments can be used. For example, any of the arrangements described above can be implemented in mirror image to that described or depicted in the figures; embodiments can be implemented on a boiler smelting off two opposing walls with the ports on the walls adjacent to the smelt walls; the ports can be located on the smelt wall (or walls) and the wall opposite; there can be an even number of primary air ports on one wall and an odd number on the opposite wall; and the primary air ports can be located on the shorter walls of a rectangular boiler. It can be seen, therefore, that many configurations and variations can be implemented without departing from the spirit of the invention.

Some embodiments provide a method of improving the performance of a chemical recovery boiler including a smelt spout wall, a wall opposite the smelt spout wall, and two side walls between the smelt spout wall and the wall opposite the smelt spout wall, comprising blocking multiple primary air ports openings on the smelt spout wall such that only between two and eight ports in the vicinity of each smelt spout are open; blocking essentially all primary air ports openings on the wall opposite the smelt spout wall; and providing at least two but no more than seven primary side wall air ports on each of the two walls side walls.

In some embodiments, the method comprises retrofitting an existing chemical recovery boiler and in which the combined opening area of the at least two but no more than seven primary ports on each of the two side walls is between 80% and 120% of the primary air port opening area of an original chemical recovery boiler being retrofitted.

In some embodiments, blocking essentially all primary air ports openings on the wall opposite the smelt spout wall comprising blocking primary air ports openings on the wall opposite the smelt spout wall such that the combined openings of the primary air ports openings on the wall opposite the smelt spout wall include less than 5% of the total area of the at least two but no more than seven primary side wall air ports on each of the two walls side walls.

In some embodiments, a volumetric flow and/or mass flow and/or velocity of at least one of the side primary air ports is adjusted to be at least 25% greater or lesser than the volumetric flow and/or mass flow and/or velocity of at least one second primary side air port opposite the first side primary port plus or minus three tube pitches creating a strong jet/weak jet relationship between said ports.

In some embodiments, said strong jet/weak jet relationship between said side air ports is periodically and automatically reversed.

In some embodiments, said strong jet/weak jet relationship alternates sequentially from port to port along one of the two side walls of the boiler.

Some embodiment provide a method of operating a chemical recovery boiler, the method comprising: injecting air through primary smelt spout air ports positioned in the vicinity of a smelt spout to maintain smelt flow at the smelt spout, the primary smelt spout air ports having a combined total primary spout air port opening area; and injecting primary air through between two and eight side wall primary air ports on each of two side walls intersecting the spout wall, the between two and eight side wall primary air ports having a combined total primary side wall air port opening area, the combined total primary side wall air port opening area including more than 80% of a total primary air port opening area.

In some embodiments, a total required quantity of primary air injected into the furnace is determined by stoichiometry and in which at least 80% of the total required quantity of primary air injected into the furnace is injected through the side wall primary air ports.

In some embodiments, less than 10% of the primary air is injected through primary air ports on the wall opposite the smelt spout wall.

In some embodiments, no primary air is injected through air ports on the wall opposite the spout wall.

In some embodiments, less than 10% of the primary air is injected through smelt spout air ports.

Although the present invention and its advantages have been described in detail, it should be understood that various changes, substitutions, and alterations can be made herein without departing from the scope of the invention as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

We claim as follows:

1. A chemical recovery boiler rectangular in plan-form draining smelt from one spout wall with no primary combustion air ports on the wall opposite the spout wall in which the spacing between individual primary ports on two walls adjacent to said spout wall shall not be less than the dimension S=0.13 times the W, the plan-form dimension of the boiler parallel to the direction of the air jet, or three feet, whichever is greater, with at least two said primary ports on each of said two walls adjacent to said spout wall with the maximum number of said primary ports on each of said walls adjacent to said spout wall no more than seven plus N where N=(D−W)/S rounded down to the next whole number and D equals the plan-form dimension of said boiler perpendicular to W, in which the volumetric flow and/or mass flow and/or velocity of at least one first said primary port is adjusted to be at least 25% greater or lesser than the volumetric flow and/or mass flow and/or velocity of at least one second said primary port opposite the first said primary port plus or minus three tube pitches creating a strong jet/weak jet relationship between said ports; and said strong jet/weak jet relationship alternates sequentially from port to port along a first wall of the boiler, said first wall adjacent to the spout wall.

2. The chemical recovery boiler of claim 1 in which all said primary ports on a first wall adjacent to said spout wall are directly opposite said primary ports on the wall opposing said first wall plus or minus three tube pitches.

3. The chemical recovery boiler of claim 2 in which a jet of combustion air emanates from each of said primary ports toward the interior of the boiler and the volumetric flow and/or mass flow and/or velocity are controlled automatically and independently for each said port.

4. The chemical recovery boiler of claim 1 in which said strong jet/weak jet relationship between said ports is periodically and automatically reversed.

5. The chemical recovery boiler of claim 1 in which the number of said primary ports on a first of said walls adjacent to said spout wall is even and the number of said primary ports on the second of said walls adjacent to said spout wall is odd.

6. The chemical recovery boiler of claim 1 in which black liquor is injected into the boiler from at least two elevations with the first elevation at least two feet above the primary port centerline elevation and no more than 12 feet above the floor of the boiler and at least three feet below the second elevation.

7. The chemical recovery boiler of claim 6 in which said first elevation is below at least one secondary port elevation.

8. A chemical recovery boiler rectangular in plan-form draining smelt from one spout wall with no primary combustion air ports on the wall opposite the spout wall in which the spacing between individual primary ports on two walls adjacent to said spout wall shall not be less than the dimension S=0.13 times the W, the plan-form dimension of the boiler parallel to the direction of the air jet, or three feet, whichever is greater, with at least two said primary ports on each of said two walls adjacent to said spout wall with the maximum number of said primary ports on each of said walls adjacent to said spout wall no more than seven plus N where N=(D−W)/S rounded down to the next whole number and D equals the plan-form dimension of said boiler perpendicular to W, in which black liquor is injected into the boiler from at least two elevations with the first elevation at least two feet above the primary port centerline elevation and no more than 12 feet above the floor of the boiler and at least three feet below the second elevation.

9. The chemical recovery boiler of claim 8 in which said first elevation is below at least one secondary port elevation.

* * * * *